US005222931A

United States Patent [19]

Roberts et al.

[11] Patent Number: 5,222,931

[45] Date of Patent: Jun. 29, 1993

[54] INTERMITTEN MOTION BAYONET HANDLE ATTACHMENT APPARATUS AND PROCESS

[75] Inventors: John T. Roberts, Clover; Claude E. Monsees, Ft. Mill, both of S.C.; Larry J. Mattson, Charlotte, N.C.; Ralph S. Goldstein, Lake Wylie, S.C.; Ronald H. Wanless, Lebanon, Ohio; Ronald O. Simpson, Charlotte, N.C.

[73] Assignee: The Procter & Gamble Company, Cincinnati, Ohio

[21] Appl. No.: 682,548

[22] Filed: Apr. 9, 1991

Related U.S. Application Data

[63] Continuation-in-part of Ser. No. 566,159, Aug. 9, 1990, Pat. No. 5,137,209.

[51] Int. Cl.[5] ..... B31B 1/86

[52] U.S. Cl. ..... 493/88; 493/226; 493/909; 493/926

[58] Field of Search ..... 493/84, 88, 226, 909, 493/926; 229/117.23, 117.24, 117.25, 117.26, DIG. 6; 53/134.1, 413

[56] References Cited

U.S. PATENT DOCUMENTS

| | | | |
|---|---|---|---|
| 2,601,816 | 7/1952 | Arneson | 493/88 |
| 3,144,196 | 8/1964 | Sindars | 229/117.24 |
| 3,204,386 | 9/1965 | Creed et al. | 53/134.1 X |
| 3,269,637 | 8/1966 | Whittaker | 229/117.24 X |
| 3,286,910 | 11/1966 | Offenburger | 229/117.24 X |
| 3,412,422 | 11/1968 | Champlin | 229/117.23 X |
| 4,986,420 | 1/1991 | Gunn et al. | 229/117.25 X |
| 5,095,683 | 3/1992 | Roberts et al. | 493/88 X |

FOREIGN PATENT DOCUMENTS

| | | | |
|---|---|---|---|
| 1016550 | 11/1952 | France | 493/88 |
| 603405 | 8/1978 | Switzerland . | |
| 1401914 | 8/1975 | United Kingdom | 493/88 |

*Primary Examiner*—Bruce M. Kisliuk
*Assistant Examiner*—John A. Marlott
*Attorney, Agent, or Firm*—E. Kelly Linman

[57] ABSTRACT

An apparatus and process for the attachment of a bayonet handle having a barb head defining each end thereof to a carton blank. The apparatus comprises releasable clamping means for horizontally gripping the handles. Below the clamping means are support means for flatly maintaining carton blanks. A pair of blades, situated juxtaposed opposite sides of the clamping means, are retractable between an upward retracted position and a downward extended position near the support means. The clamping means are movable between an upper handle receiving position and a lower position near the support means by descending means.

The process comprises first providing a bayonet handle. The handle is next bent in two places so that the barb heads are perpendicular to an interior section of the handle and are projecting toward respective apertures in the carton blank. Then, the handle is moved such that the barb heads are inserted into the respective apertures. Thus, barbs on the barb heads are engaged and the handle is attached to the blank.

12 Claims, 7 Drawing Sheets

INTERMITTEN MOTION BAYONET HANDLE ATTACHMENT APPARATUS AND PROCESS

CROSS REFERENCE TO RELATED APPLICATION

This application is a continuation-in-part of application Ser. No. 07/566,159, filed Aug. 9, 1990 now U.S. Pat. No. 5,137,209.

BACKGROUND OF THE INVENTION

This invention relates generally to the art of packaging and more particularly to an apparatus and process of attaching an elongated bayonet handle to a carton blank.

The bayonet handle package, first seen in U.S. Pat. No. 4,986,420, issued to Gunn et al. on Jan. 21, 1991, is a significant development in the packaging and marketing of detergent powder and other particulate commodities. The package developed as a response to difficulties in the marketing of the new high density laundry detergents. Such detergents require a package with a hinged top so that the consumer can scoop relatively precise amounts of detergent each time. Since the top is hinged, it is preferable that a handle for the package be attached to the sides and not to the top. The bayonet handle package provides such a container.

While some prior art handles are also attached to the sides of the package, the attachment is generally accomplished by riveting. The riveting process, however, is slow and prone to frequent failure. This greatly increases the cost of the package to the eventual consumer.

The bayonet handle, on the other hand, is folded and inserted into apertures in the carton blank such that barbs on the ends of the handle are ensnared on the aperture lip. Attachment is therefore completely accomplished by the combination of the aperture and the shape of the handle. Since the need for a rivet or like attachment means is eliminated, the bayonet handle inherently lends itself to more efficient manufacture. The machinery, however, necessary to fully exploit the advantages of the bayonet handle design has not appeared in the prior art.

SUMMARY OF THE INVENTION

It is thus an object of this invention to provide an apparatus to facilitate the attachment of an elongated bayonet handle to a carton blank.

It is a further object of the invention to provide an intermittent motion apparatus for the assembly of a bayonet handle package.

It is a further and more particular object of this invention to provide a relatively compact and inexpensive intermittent motion apparatus for the assembly of a bayonet handle package.

It is also a object of the invention to provide a novel process for the insertion of an elongated bayonet handle having barb heads defining respective ends thereof to a carton blank having a pair of handle insertion apertures resulting in attachment of the handle thereto.

Some of these, as well as other, objects are accomplished by an apparatus for the attachment of a bayonet handle having a barb head defining each end thereof to a carton blank. The apparatus comprises releasable clamping mean for horizontally gripping the handles. Below the clamping means are support means for flatly maintaining carton blanks. A pair of blades, situated juxtaposed opposite sides of the clamping means, are retractable between an upward retracted position and a downward extended position near the support means. The clamping means are movable between an upper handle receiving position and a lower position near the support means by descending means.

The process comprises first providing a bayonet handle. The handle is next bent in two places so that the barb heads are perpendicular to an interior section of the handle and are projecting toward respective apertures in the carton blank. Then, the handle is moved such that the barb heads are inserted into the respective apertures. Thus, barbs on the barb heads are engaged and the handle is attached to the blank.

DETAILED DESCRIPTION

In accordance with this invention, it has been found that a novel intermittent motion apparatus having a handle attachment apparatus thereon may be provided to facilitate the assembly of a bayonet handle package. The handle attachment apparatus functions to automatically grip, bend and move an appropriately positioned handle whereby barb heads defining each end thereof are inserted into handle insertion apertures in the carton blank. The assembled package can then be further processed, such as by a folder/gluer machine, to form a completed bayonet handle package to which particulate product may be added.

Figure 1:
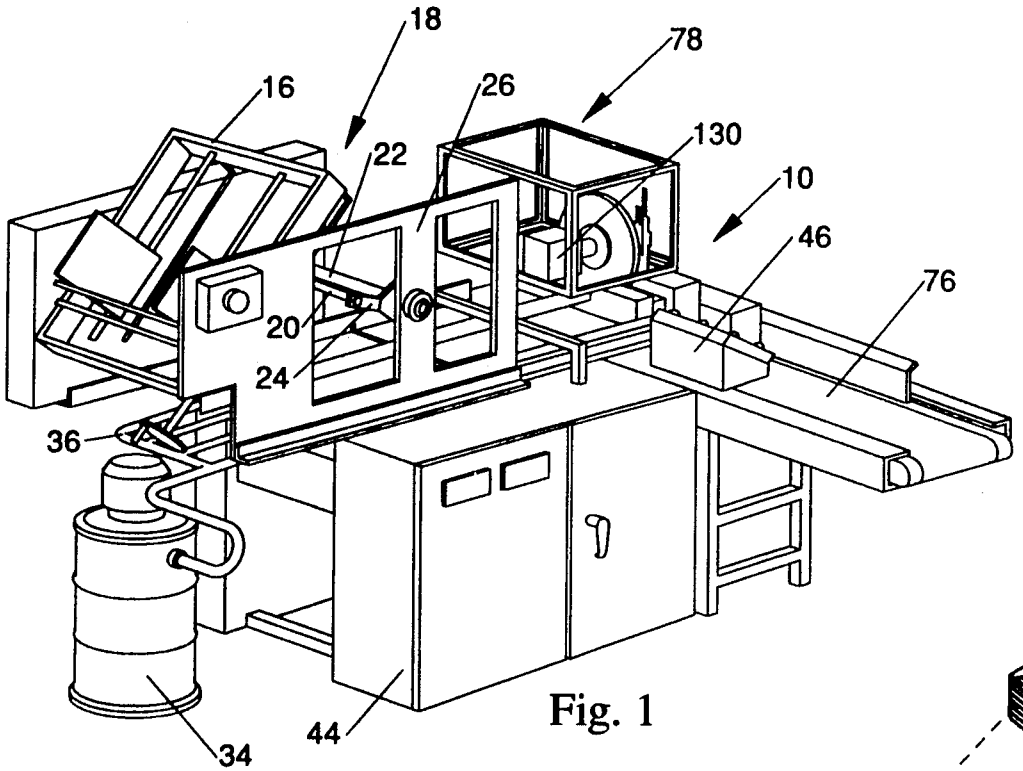
FIG. 1 is a perspective view of a preferred embodiment of an automatic intermittent motion bayonet handle package assembly apparatus constructed in accordance with the invention.
Figure 2:
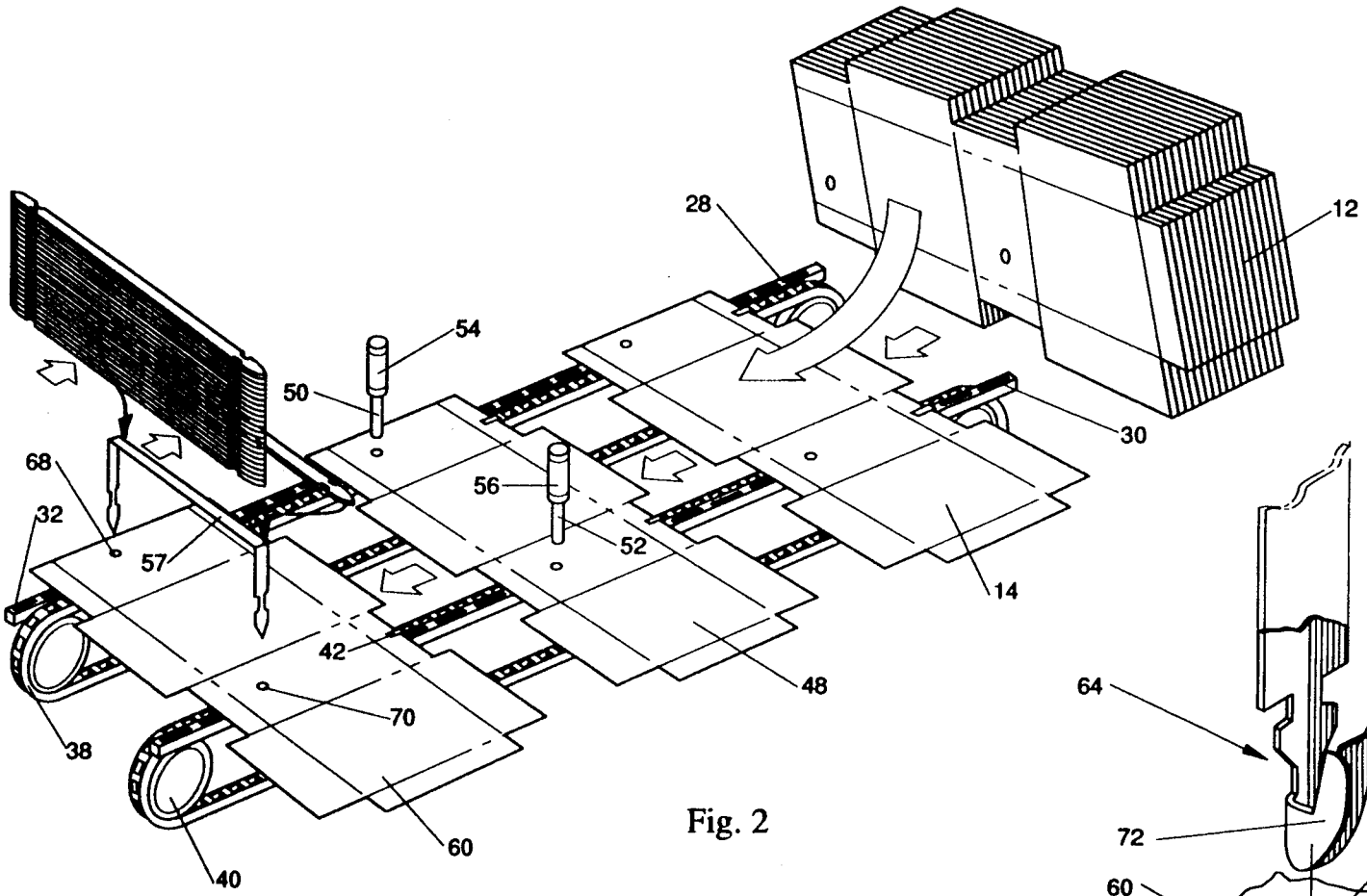
FIG. 2 is a perspective schematic illustrating in simplified form the operation of the apparatus of FIG. 1.

Referring now to the drawings, and particularly to FIGS. 1 and 2, an apparatus constructed in accordance with the invention as well as the process of the invention will be explained with diagrammatic reference to machine 10. The invention contemplates a source of carton blanks, such as stack 12, from which individual blanks, such as 14, are retrieved for processing. For this purpose, machine 10 is constructed having a blank hopper 16.

Blanks 14 are individually retrieved from hopper 16 by pick-and-place mechanism 18. As shown, mechanism 18 is of the well known type wherein a plurality of rods, such as rod 20, each having a series of suction cups (not shown) thereon, are displaced about shaft 22 parallel and concentric therewith. Rod 20, as well as the other similar rods, are journalled into web member 24, which extends radially from shaft 22 and is fixedly attached thereto. Shaft 22 is, in turn, journalled into machine frame 26. Thus, the rods rotate with respect to web member 24 whereas shaft 22 rotates with respect to frame 26. This action first causes the suction cups to rotate into the bottom blank of stack 12, thereby retrieving it. The retrieved blank is then deposited onto a generally horizontal support means, such as parallel longitudinal support rods 28 and 30.

The longitudinal support rods are preferably of hollow construction and define along an upper edge thereof a series of longitudinal slots, such as 32. A vacuum source, such as vacuum motor 34, is connected to the ends of the support rods via tubing 36. Negative pressure is thus produced at the slots, thereby maintaining blanks securely and flatly upon the support rods.

After being deposited, the blanks are singularly advanced (as shown by the directional arrows of FIG. 2) for formation of the handle insertion apertures and subsequent handle attachment. A number of conveyor configurations are undoubtedly suitable for transporting blanks in this way. For illustration, however, the blank transport means is shown comprising flighted chains 38 and 40 having lugs, such as 42, thereon. The intermittent advancement motion of chains 38 and 40 is provided by a Camco geneva drive configuration which, along with other mechanical and electrical components is maintained within housing 44 and controlled by operator controls at 46.

For aperture formation, the blank is first advanced a distance of at least one blank width (measured in the direction of movement). This allows space on the support rods for a subsequent blank which may be thereafter similarly retrieved and deposited. At this location, the blank, such as blank 48, stops. Typically, the apertures are preformed by perforation at the time the blank itself is manufactured. Thus, at this stage, aperture formation may be completed by simply removing the inner disc, or "slug." In the preferred embodiment, slug removal is accomplished by a pair of dies 50 and 52 attached to and freely reciprocal with air cylinders 54 and 56, respectively. As an alternative to a pair of air cylinders, a single air cylinder appropriately configured or electrically controlled solenoids may be substituted. Dies 50 and 52 are positioned above rods 38 and 40 in respective register with complementary bores (not shown) therein. Thus, dies 50 and 52 simply knock the slugs into the rods so that they can be carried away by vacuum motor 34.

With aperture formation complete, the blank again advances at least one blank width, there stopping. At this point, a handle, such as 57, which has been supplied and transported from fused handle cartridge 58 or other appropriate source of handles, is attached to the blank, such as blank 60.

Figure 3:
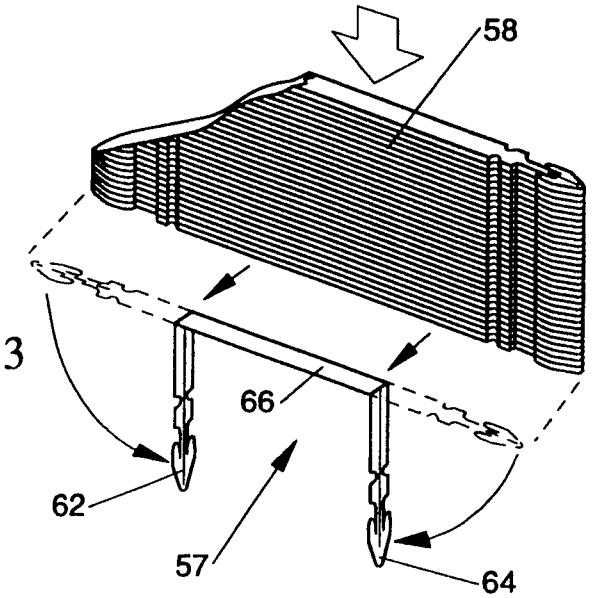
FIG. 3 is a perspective schematic illustrating a single handle being removed from the bottom of a fused handle cartridge and folded for attachment to a carton blank.
Figure 4:
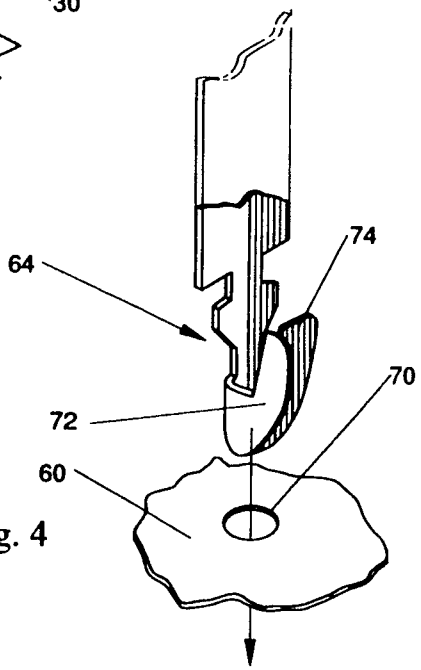
FIG. 4 a fragmentary perspective view of a bayonet handle barb head being inserted into an aperture defined by a carton blank.

The handle attachment process is most readily understood with reference to FIGS. 2, 3 and 4. First, handle 57 is laterally sheared from the bottom of cartridge 58. Then, handle 57 is bent such that opposite barb heads 62 and 64 are disposed perpendicular to handle interior section 66 and are projecting downward toward apertures 68 and 70, respectively. Next, handle 57 is lowered, thereby inserting barb heads 62 and 64 into apertures 68 and 70. In this way, barbs defined by the barb heads, such as barbs 72 and 74 of barb head 64, are engaged and retained behind blank 60 and handle 57 is consequently attached thereto.

Referring particularly to FIG. 4, it has been found that best results are obtained when the barb heads are crimped prior to insertion. This reduces the width of the barb heads, thus facilitating insertion and allowing for greater margin of error in alignment.

After handle attachment, the blank again advances, wherein conveyor 76 carries the assembled package away for further processing, such as by a folder/gluer machine.

Figure 6:
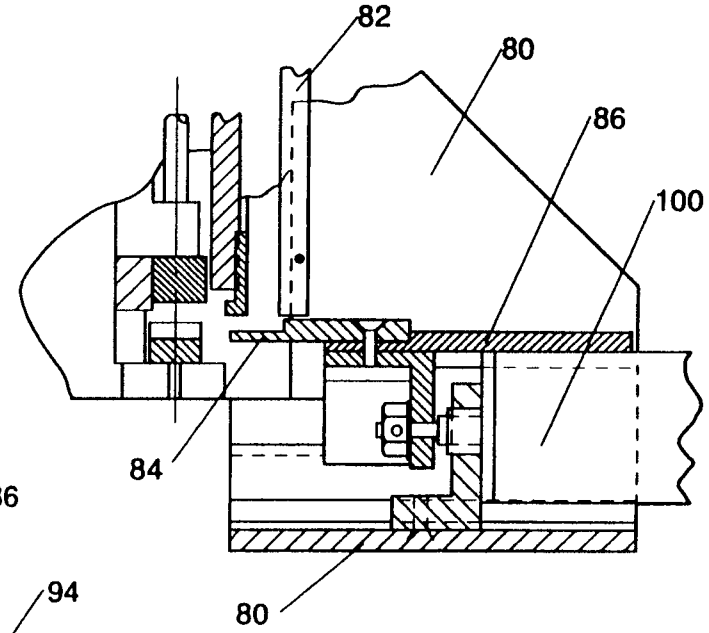
FIG. 6 is a partial cross-sectional view along line 6 of FIG. 6.
Figure 5:
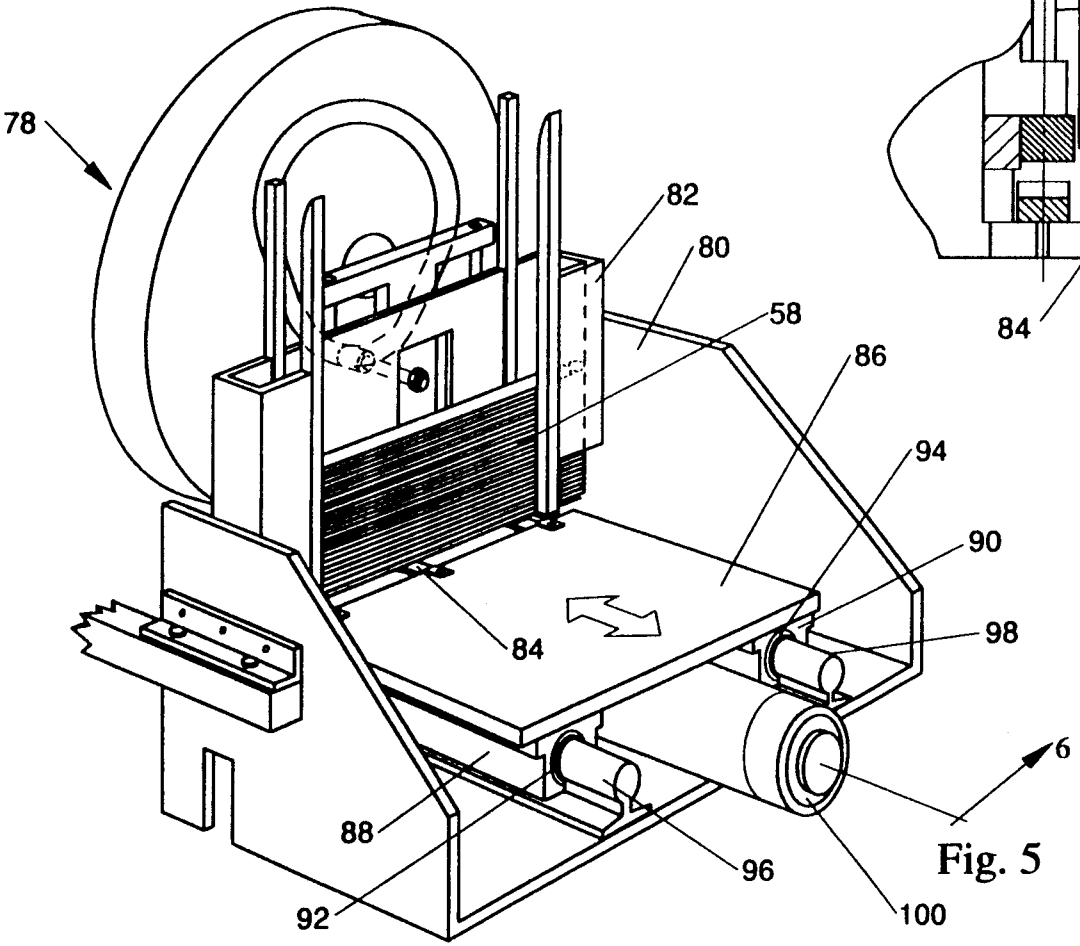
FIG. 5 is a fragmentary perspective view illustrating component parts of the apparatus of the invention utilized for bayonet handle attachment and further illustrating a handle cartridge magazine mounted thereon and loaded with a handle cartridge.

FIGS. 5 through 10 illustrate the handle attachment apparatus 78 utilized for handle insertion and attachment as described. Referring particularly to FIGS. 5 and 6, the means of supplying individual handles from cartridge 58 is readily apparent. Permanently affixed to machine frame 80 is magazine 8 which is appropriately configured to contain a handle cartridge. Individual handles are sheared from the bottom of cartridge 58 by the reciprocating motion of a shearing finger, such as 84, mounted to the leading edge of handle feeder plate 86. Below plate 86 and attached thereto are guide blocks 88 and 90 which define guide slots 92 and 94, respectively. Guide slots 92 and 94, in turn, slidably engage rails 96 and 98, respectively, which are affixed to frame 80. Reciprocation (as shown by the arrow of FIG. 5) is provided by air cylinder 100.

Figure 7:
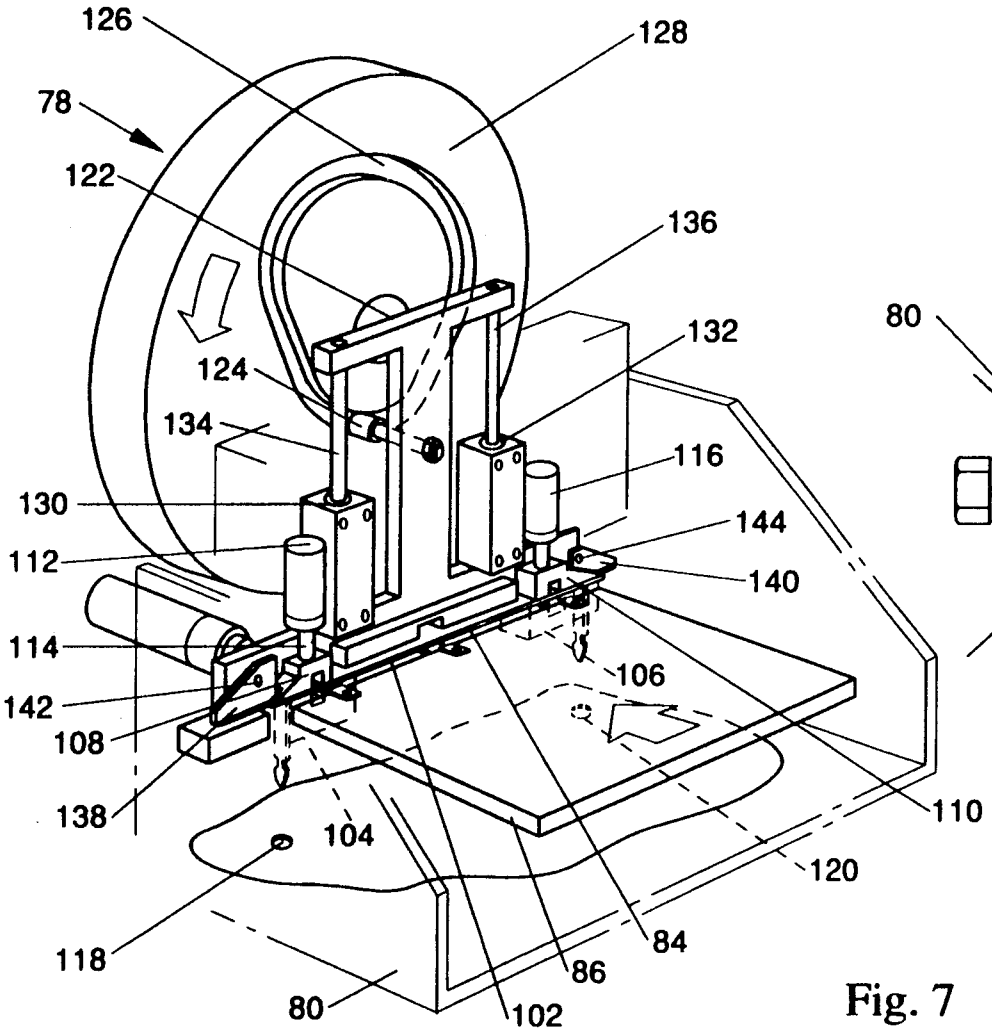
FIG. 7 is a view similar to FIG. 5 with the handle cartridge magazine removed wherein components otherwise obscured are revealed.
Figure 10:
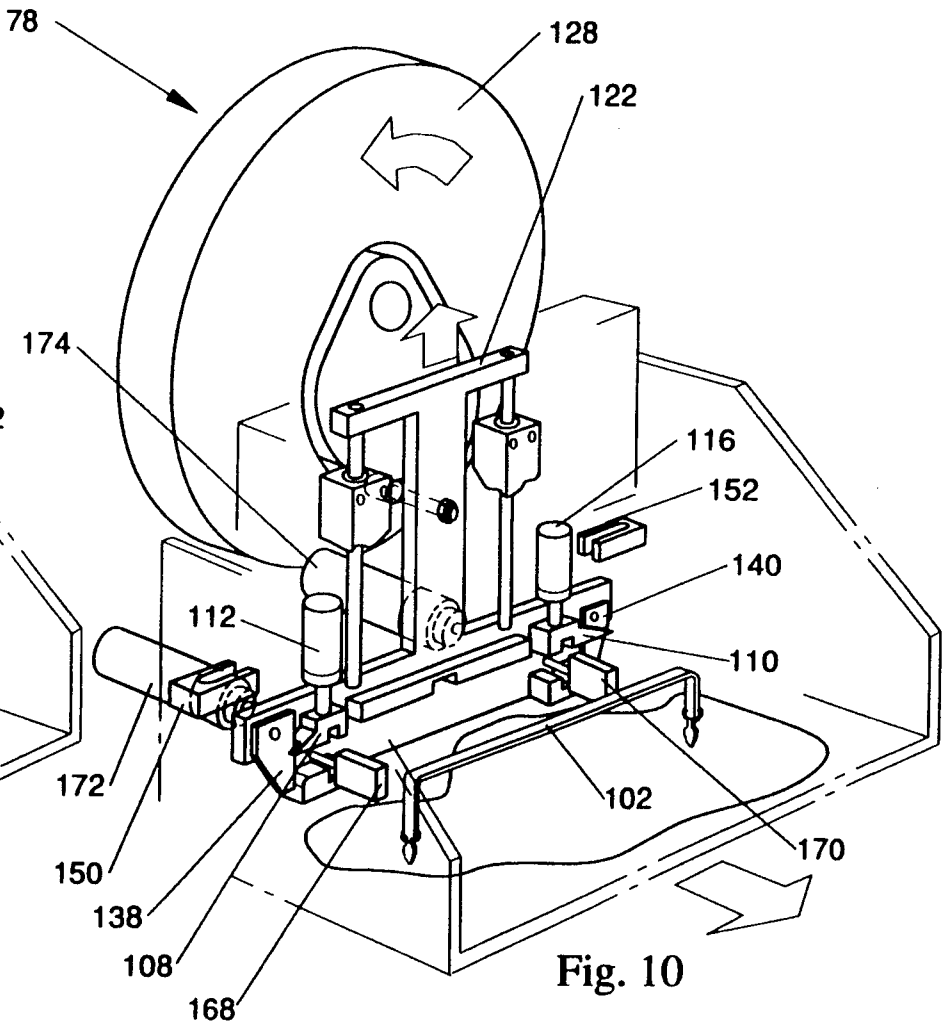
FIGS. 9 and 10 are views similar to FIG. 7 sequentially illustrating handle attachment.
Figure 9:
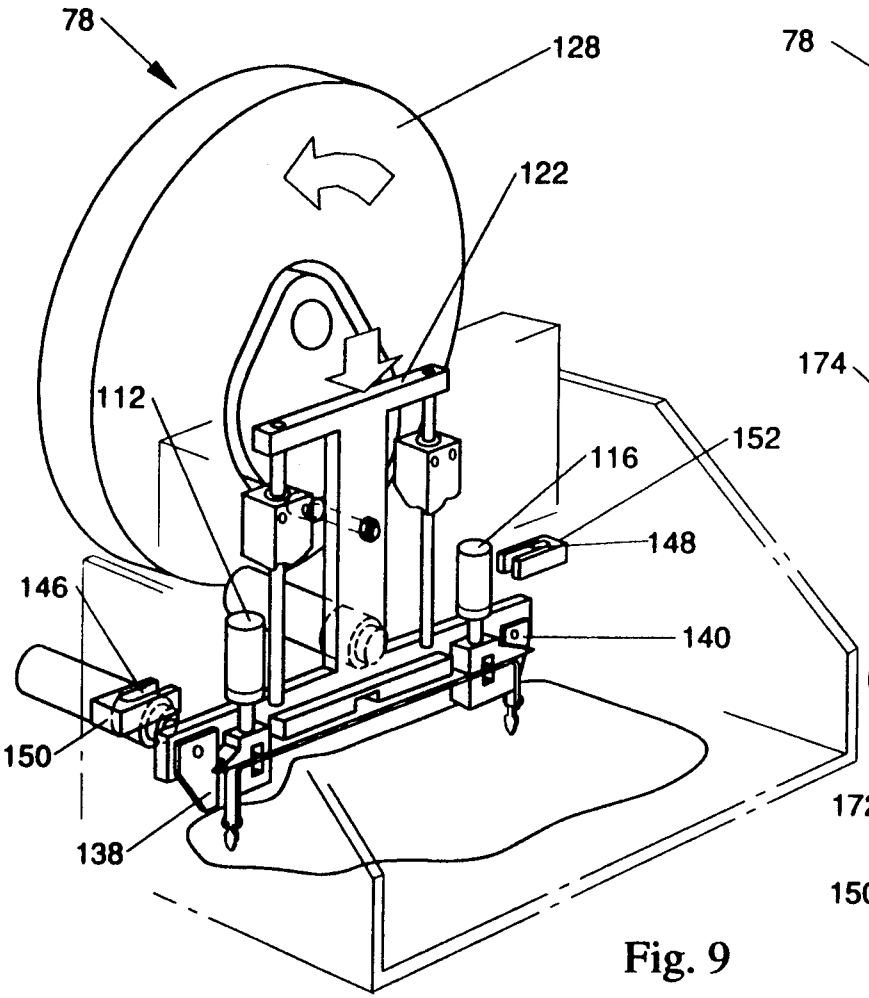

With magazine 82 removed, as in FIGS. 7, 9 and 10, additional components are visible. FIG. 7 illustrates the handle gripping and bending function of the apparatus. A handle 102 is laterally pushed by the shearing fingers into a horizontal position where it may be gripped by the clamping means of the invention. Typically, the clamping means will comprise a pair of clamping bases, such as 104 and 106, disposed below clamping shoes, such as 108 and 110, respectively. Clamping shoe 108 is attached to and is vertically reciprocal with air cylinder 112 via rod 114. Similarly, clamping shoe 110 is attached to air cylinder 116. Thus, handle clamping and release is achieved by the vertical reciprocal movement of the shoes relative to their respective bases.

After the handle is gripped by the clamping means in the upper handle receiving position, descending means are required to move the handle downward so that the barb heads can be inserted into handle insertion apertures 118 and 120. For this purpose, descending plate 122 is provided. Bases 104 and 106 are affixed to plate 122, as are cylinders 112 and 116. Consequently, these components "ride" plate 122 as it moves up and down. This movement is accomplished by the captive engagement of cam follower 124 within elliptical cam track 126 of cam disc 128. Disc 128 is rotatably driven by a continuous drive motor coupled thereto via right angle gearbox 130 (FIG. 1). Guide blocks 130 and 132 slidably engage guide rods 134 and 136, respectively, which are secured to plate 122. Blocks 130 and 132 are fixedly attached to magazine 82, as seen in FIG. 5. Thus, plate 122 is steered in strict reciprocal movement as disc 128 rotates.

However, in order for handle attachment to occur, the barb heads must be crimped and projecting toward the apertures, as discussed above. For this purpose, blade 138 is provided juxtaposed the outside of clamping shoe 108 and similarly, blade 140 is provided juxtaposed the outside of clamping shoe 110. Blades 138 and 140 are pivotally attached to descending plate 122 at pivots 142 and 144, respectively.

When a handle is received into the clamping means, blades 138 and 140 will be in their upward retracted position which is necessarily slightly higher than the position of a handle received into the clamping means. However, as the rotation of disc 128 causes plate 122 to lower, blades 138 and 140 pivot and descend into a downward extended position. While pivoting, the blades push barb heads thereunder through slots 146 and 148 (FIG. 9) defined by U-shaped anvils 150 and 152, respectively, which are below the barb heads when the handle is received into the clamping means. Anvils 150 and 152 thereby crimp the barb heads. Preferably, the barb heads will each have a cut score extending longitudinally thereon which will be "broken" by the anvil. The score contributes to the memory of the crimp so that it can be effectively maintained until handle insertion and consequent attachment is complete.

Figure 8:
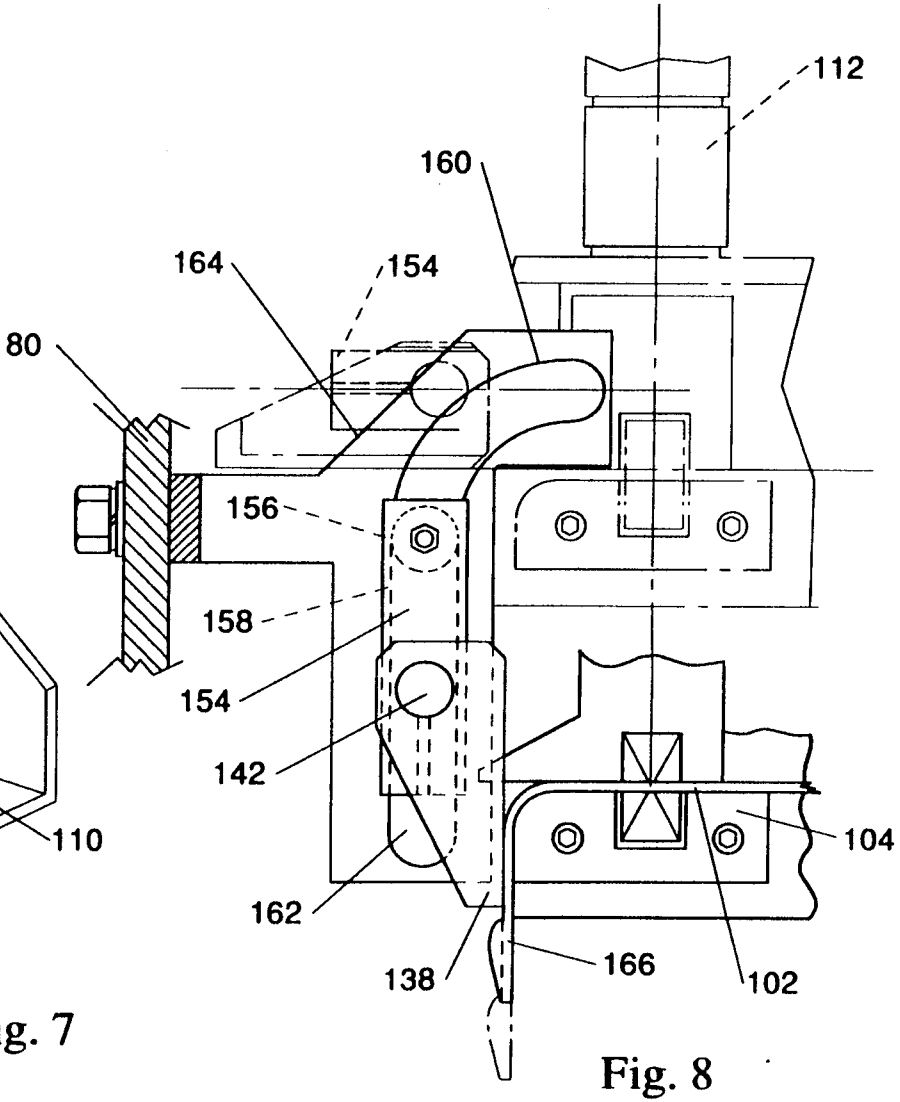
FIG. 8 is a fragmentary, elevation view illustrating a barb head crimping blade of the apparatus functioning to perpendicularly bend a barb head.

Referring to FIG. 8, wherein descending plate 122 is omitted, the pivoting and descending action of blade 138 is illustrated. Blade 140, of course, operates similarly. Behind plate 122 is fixedly secured to blade 138 a lever 154 having a cam follower 156 at the end thereof opposite pivot 142. Follower 156 is captively engaged within cam groove 158 which has an arcuate upper section 160 and a vertical lower section 162. Groove 158 is defined by member 164 which is fixedly attached to frame 80. As blade 138 reaches its extended and pivoted position as shown, it functions as a guide rail directing a barb head, such a barb head 166, into its target aperture.

As can be seen in FIG. 10, upon handle attachment, shoes 108 and 110 are raised by cylinders 112 and 116, respectively. Thus, handle 102 is released. Additionally, ejection blocks 168 and 170, which are attached to cylinders 172 and 174, respectively, extend, thereby "kicking" handle 102 out of the clamping means. The continued rotation of disc 128 raises the clamping means back to the handle receiving position so that the process can be repeated.

Figure 11:
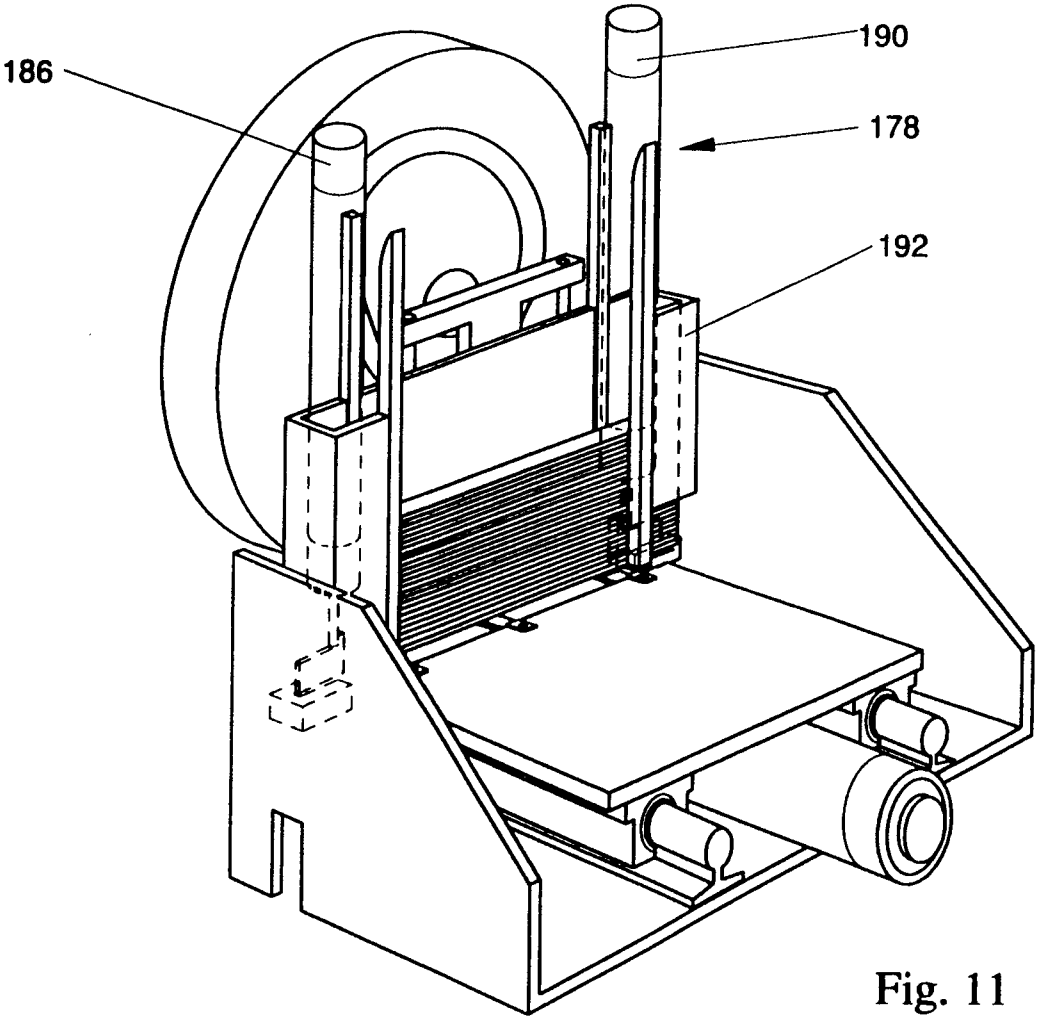
FIG. 11 is a fragmentary perspective view of an alternative embodiment of the handle attachment apparatus.
Figure 13:
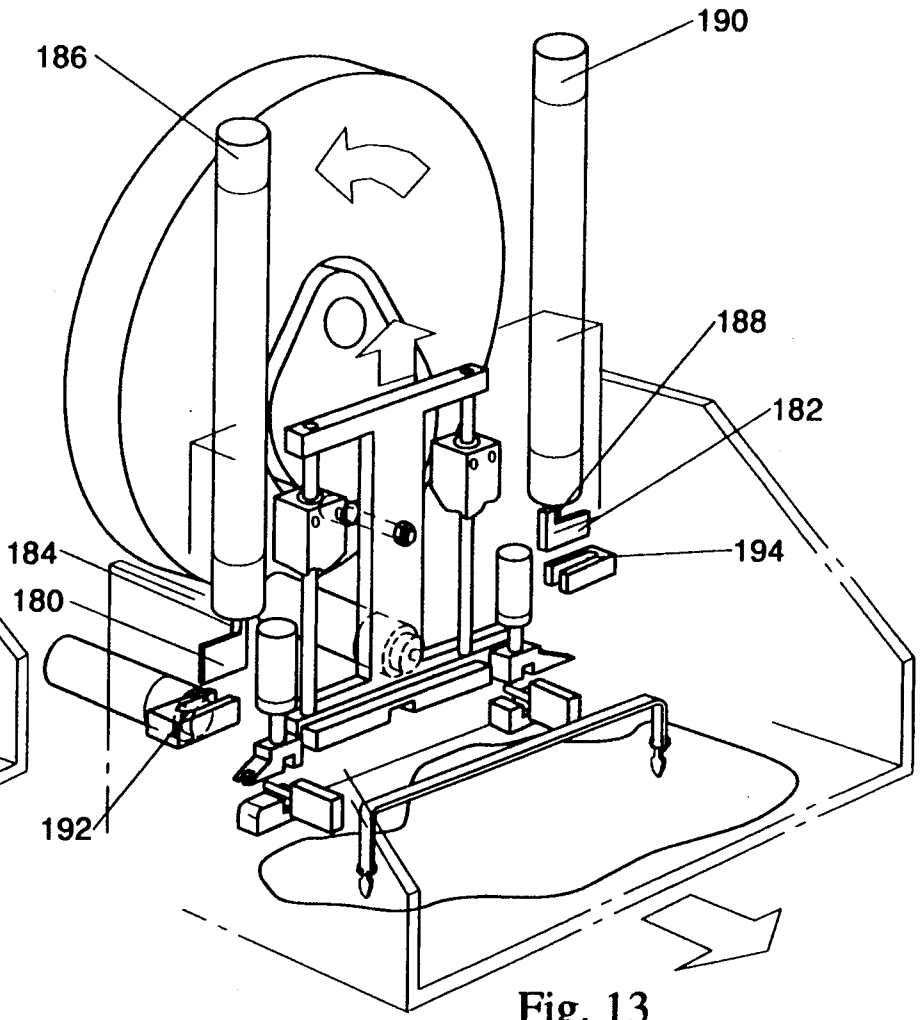
FIGS. 12 and 13 are views similar to FIG. 11 with the handle cartridge magazine removed.
Figure 12:
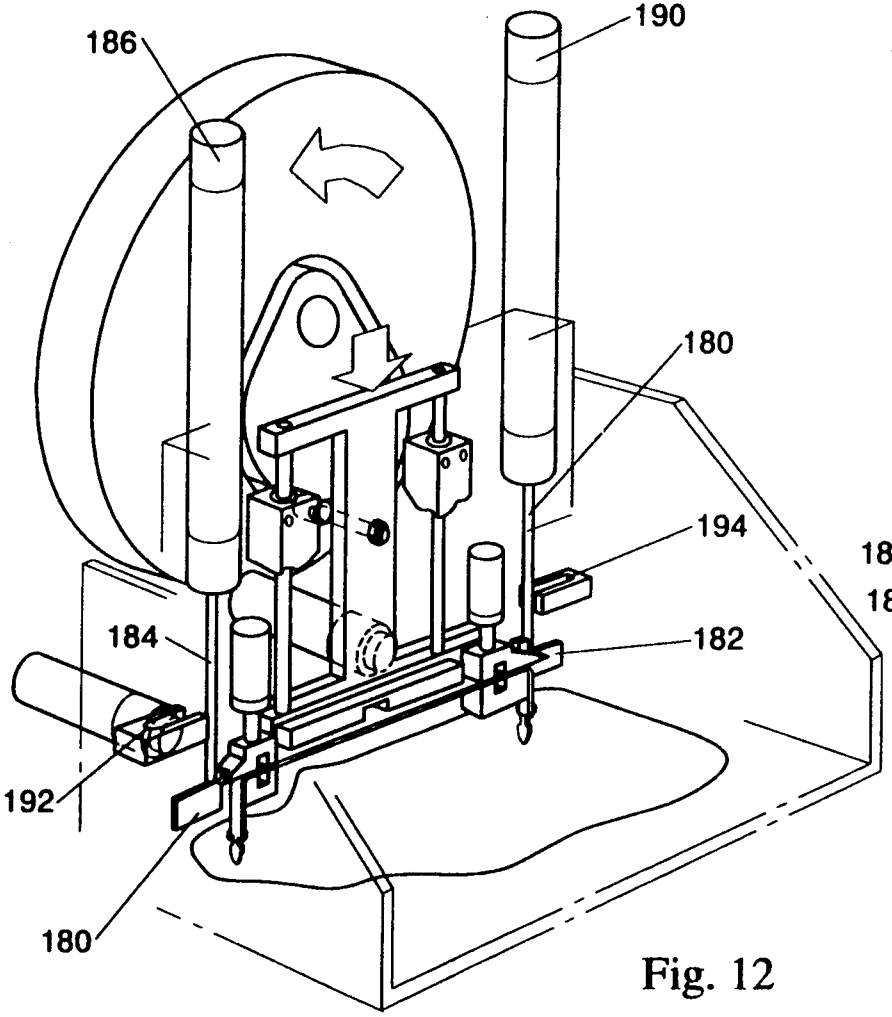

FIGS. 11 through 13 illustrate an alternative embodiment of the handle attachment apparatus wherein a slightly different blade configuration is utilized. With the exception of the blades and their attendant components, all other aspects may be identical to the embodiment described above with reference to FIGS. 5 through 10.

Instead of pivoting blades, apparatus 178 has reciprocal blades 180 and 182. Blade 180 is attached to piston rod 184 of air cylinder 186. Similarly, blade 182 is attached to piston rod 188 of air cylinder 190. As seen in FIG. 11, cylinders 186 and 190 are fixedly mounted on cartridge magazine 192.

As with the previous embodiment, blades 180 and 182 are retracted above the barb heads as a handle is initially received by the clamping means. Then, blades 180 and 182 descend to an extended downward position. This pushes the barb heads through respective anvils 192 and 194, thus crimping the barb heads. Next, as shown in FIG. 12, the descending means lower, inserting the barb heads into the apertures. The barb heads are guided while being inserted by blades 180 and 182. Subsequently, as seen in FIG. 13, blades 180 and 182 retract and the handle is ejected.

It can thus be seen that the instant invention provides a novel apparatus to facilitate the attachment of an elongated bayonet handle to a carton blank. It is further see that the invention provides a relatively compact and inexpensive intermittent motion apparatus for the assembly of bayonet handle packages in an industrial application. A novel process for the attachment of a bayonet handle to a carton blank has also been provided.

Many variations will undoubtedly become apparent to one skilled in the art upon a reading of the above specification with reference to the drawings. Such variations, however, are within the spirit and scope of the invention as defined by the following appended claims.

That which is claimed is:

1. An apparatus for the attachment of an elongated bayonet handle having a first barb head defining a first end thereof and an opposite second barb head defining a second end thereof to a carton blank having a pair of handle insertion apertures, said apparatus comprising:

releasable clamping means for horizontally gripping said handle at an interior section inward of said barb heads;

support means below said clamping means for flatly maintaining said carton blank;

descending means attached to said clamping means for moving said clamping means between a first handle receiving position and a second lower position proximate said support means;

a first blade juxtaposed an outside of said clamping means and movable between an upward retracted position above said handle receiving position and a downward extended position proximate said support means;

a second blade juxtaposed an outside of said clamping means opposite said first blade and movable similarly to said first blade between an upward retracted position above said handle receiving position and a downward extended position proximate said support means, whereby said blades simultaneously extend downward onto the respective barb heads of a handle gripped by said clamping means to bend said barb heads downward to be perpendicular to said interior section of said handle and projecting toward said apertures, said descending means thereafter moving said handle downward to insert the barb heads into the apertures, and finally said clamping means releasing said handle.

2. An intermittent motion apparatus for the automatic assembly of a package comprising a carton blank having a pair of handle insertion apertures and an elongated bayonet handle having a first barb head defining a first end thereof and an opposite second barb head defining a second end thereof, said apparatus comprising:

a source of carton blanks;

a source of bayonet handles;

releasable clamping means for singularly receiving said handles from said source of bayonet handles and horizontally gripping said handle at an interior section inward of said barb heads;

support means below said clamping means for flatly maintaining said carton blank;

means for singularly transporting said carton blanks from said source of carton blanks to said support means;

descending means attached to said clamping means for moving said clamping means between a first handle receiving position and a second lower position proximate said support means;

a first blade juxtaposed an outside of said clamping means and movable between an upward retracted position above said handle receiving position and a downward extended position proximate said support means;

a second blade juxtaposed an outside of said clamping means opposite said first blade and movable similarly to said first blade between an upward retracted position above said handle receiving position and a downward extended position proximate said support means, whereby a carton blank is delivered from said carton blank source to said support means and a handle is delivered to said clamping means, subsequently said blades simultaneously extend down onto the respective barb heads of said handle to bend said barb heads downward to be perpendicular to said interior section of said handle and projecting toward said apertures, then said descending means moving said handle downward to insert the barb heads into the apertures, and finally said clamping means releasing said handle and said carton blank with said handle attached is purged for further processing.

3. The apparatus in accordance with claim 2 further comprising means to form said apertures in said carton blank.

4. The apparatus constructed in accordance with claim 2 further comprising at least one air cylinder for moving said first blade and said second blade between said upward retracted position and said downward extended position.

5. The apparatus in accordance with claim 2 wherein said descending means comprises a rotary drive, a cam attached to said drive and a cam follower engaging said cam and attached to said clamping means.

6. The apparatus in accordance with claim 5 wherein said cam comprises a disc defining an elliptical cam track.

7. The apparatus in accordance with claim 2 wherein said support means comprises a plurality of parallel, generally horizontally mounted longitudinal rods.

8. The apparatus in accordance with claim 7 further comprising at least one flighted chain for advancing said cartons upon said support means.

9. The apparatus in accordance with claim 7 wherein said rods are hollow and define along an upper edge thereof a series of longitudinal slots, and wherein said apparatus further comprises a vacuum source in communication with said hollow rods whereby said vacuum source causes negative pressure at said slots to flatly and securely maintain said carton blanks upon said longitudinal rods.

10. The apparatus in accordance with claim 3 wherein said means to form said apertures in said carton blank comprises a pair of dies attached to at least one air cylinder and freely reciprocal therewith.

11. The apparatus in accordance with claim 2 wherein said blades are pivotally attached to said descending means freely descendible therewith, each said blade further having a lever securely affixed thereto, each said lever having a cam follower thereon engaged with a cam track for pivoting said blades.

12. A process of attaching an elongated bayonet handle having a first barb head defining a first end thereof and an opposite second barb head defining a second end thereof to a carton blank having a pair of handle insertion apertures, said process comprising:

(a) providing an apparatus comprising:

releasable clamping means for horizontally gripping said handle at an interior section inward of said barb heads;

support means below said clamping means for flatly maintaining said carton blank;

descending means for moving said clamping means between a first handle receiving position and a second lower position proximate said support means;

a first blade juxtaposed an outside of said clamping means and movable between an upward retracted position above said handle receiving position and a downward extended position proximate said support means; and, a second blade juxtaposed an outside of said clamping means opposite said first blade and movable similarly to said first blade between an upward retracted position above said handle receiving position and a downward extended position proximate said support means;

(b) moving a bayonet handle to a location for gripping by said releasable clamping means when in said handle receiving position;

(c) gripping said handle with said clamping means;

(d) flatly positioning a carton blank upon said support means;

(e) simultaneously extending said first blade and said second blade from said retracted position to said extended position, thereby causing said barb heads to be bent downward perpendicular to said interior section of said handle and projecting toward said apertures;

(g) utilizing said descending means to lower said clamping means from the handle receiving position to the lower position proximate said support means thereby causing said barb heads to be inserted into said apertures.

* * * * *